United States Patent [19]

Wilks

[11] 4,309,684

[45] Jan. 5, 1982

[54] ELECTRIC FUSE HAVING LARGE CYCLING ABILITY AND GAS-EVOLVING MEANS

[75] Inventor: Howard G. Wilks, Amesbury, Mass.

[73] Assignee: Gould Inc., Rolling Meadows, Ill.

[21] Appl. No.: 189,520

[22] Filed: Sep. 22, 1980

[51] Int. Cl.[3] ..... H01H 85/38

[52] U.S. Cl. ..... 337/273; 337/161; 337/278

[58] Field of Search ..... 337/273, 274, 275, 276, 337/278, 279, 280, 282, 158, 159, 161, 162, 281, 293; 200/149 A, 150 D, 151

[56] References Cited

U.S. PATENT DOCUMENTS 3,256,409 6/1966 Brandt ..... 337/161

4,167,723 9/1979 Wilks ..... 337/273

*Primary Examiner*—Harold Broome

*Attorney, Agent, or Firm*—Erwin Salzer

[57] ABSTRACT

A fuse having a high cycling ability combined with a high arc-extinguishing ability due to the presence of a gas-evolving material. The fuse includes a pair of fusible elements having end portions and intermediate portions arranged between the end portions and converging in opposite directions, so as to form a pair of wedge-like structures. The pair of fusible elements is composed of planar portions and portions where these planar portions meet. The fusible element has points of minimized cross-section which are spaced from any bent in the fusible element. The improvement comprises a rectangular plate of gas-evolving material inserted into the gap, or space, defined by the pair of parallel fusible elements. The terminal elements of the fuse and its casing form abutments for the plate of gas-evolving material in longitudinal and in transverse direction so that no additional means are required for maintaining the gas-evolving plate in position relative to the pair of fusible elements of the fuse.

3 Claims, 3 Drawing Figures

ELECTRIC FUSE HAVING LARGE CYCLING ABILITY AND GAS-EVOLVING MEANS

BACKGROUND OF THE INVENTION

This invention relates to an improvement of the invention disclosed in detail in U.S. Pat. No. 3,493,333; 07/23/68 to P. C. Jacobs, Jr. for ELECTRIC FUSE HAVING STRESS REDUCING FUSE LINK MEANS.

The above prior art patent discloses a fuse structure having a large cycling ability, i.e. an ability to carry and drop loads which are subjected to a frequent, or repetitive, more or less regular cycle. The present invention solves the problem of imparting an increased interrupting ability to the structure described in the above prior art patent.

The closest prior art known in addition to the above patent is U.S. Pat. No. 4,167,723 To Howard G. Wilks for ELECTRIC FUSE HAVING GAS-EVOLVING MATERIAL. This patent shows a fuse having a limited cycling ability, and requires structure of gas-evolving materials— i.e. materials that evolve gases under the action of electric arcs that are structurally complex and hence difficult to manufacture.

It is the prime object of this invention to provide fuses having a high cycling ability, and highly effective gas-evolving means which are inexpensive to manufacture and inexpensive to install. As far as cycling ability is concerned, the latter is achieved in the same way as in the above patent to Jacobs, and the present invention differs from the structure disclosed in the patent to Jacobs only inasmuch as its gas-evolving means are concerned.

SUMMARY OF THE INVENTION

This invention relates to a fuse as described in U.S. Pat. No. 3,493,333 to P. C. Jacobs, Jr. The improvement comprises a sheet of electric insulating material evolving gas under the action of an electric arc inserted into the gap formed between said pair of fusible elements, said sheet of electric insulating material having a length but slightly shorter than the spacing between said axially inner end surfaces of said pair of terminal elements so as to be substantially prevented from moving relative to said pair of fusible elements in a direction longitudinally of said casing, said sheet of insulating material having a width but slightly less than the inner diameter of said casing so as to be substantially prevented from moving relative to said pair of fusible elements in a direction transversely of said casing.

DESCRIPTION OF PREFERRED EMBODIMENT

Figure 1:
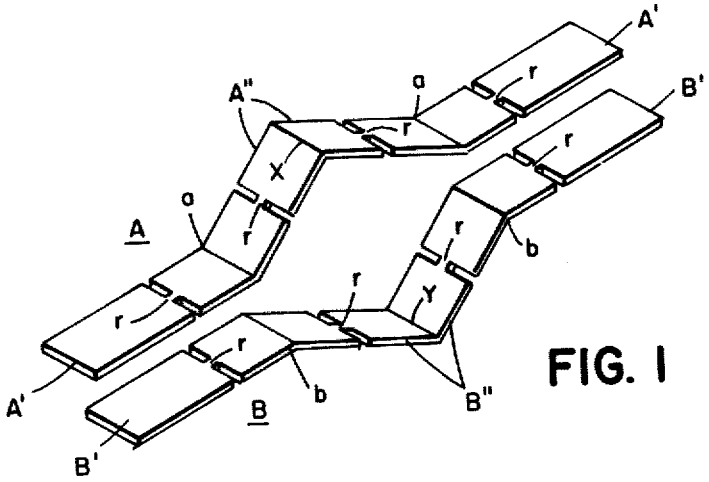
FIG. 1 is an isometric view of the fusible elements which may be used in a fuse according to this invention.
Figure 2:
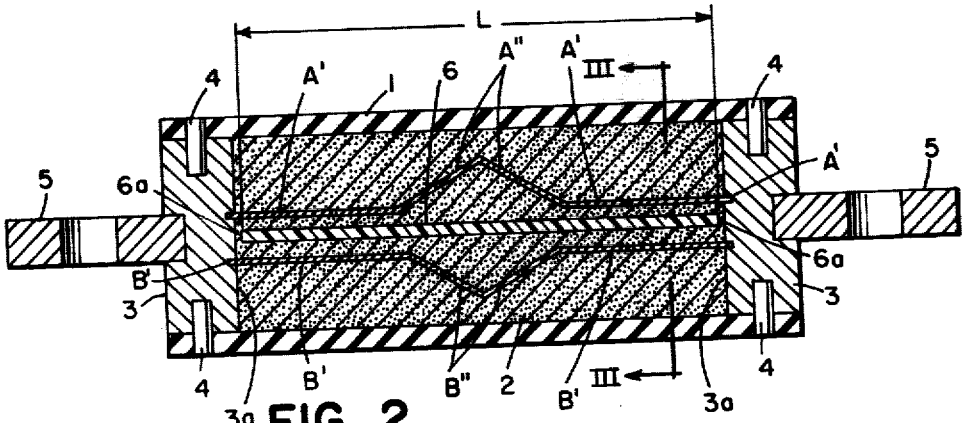
FIG. 2 is a section of a fuse along II—II of FIG. 3 of a preferred embodiment of the invention.
Figure 3:
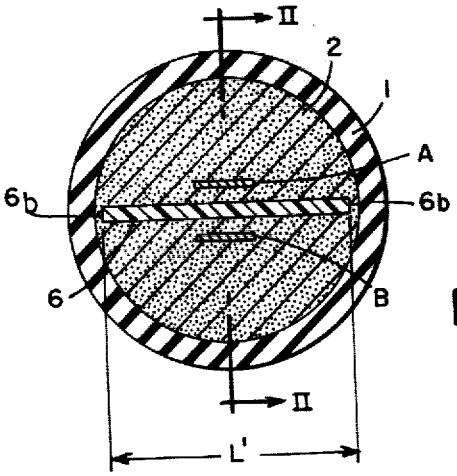
FIG. 3 is a section along III—III of FIG. 2.

Referring now to the drawings, numeral 1 has been applied to indicate a tubular casing of electric insulating material such as, for instance, a synthetic resin-glass-cloth laminate. Casing 1 is filled with a pulverulent arc-quenching filler 2 such as, for instance, quartz sand. Terminal elements 3 having axially inner end surfaces 3*a* close the ends of casing 1. In the embodiment shown the terminal elements 3 are shown to be in the form of metal plugs, but other terminal elements may be applied, e.g. terminal caps. A pair of fusible elements A and B conductively interconnect terminal elements 3. Pins 4 projecting through casing 1 into terminal plugs 3 affix these parts to each other. Blade contacts 5 projecting axially outwardly from terminal plugs 3 may be provided for conveniently connecting the fuse into an electric circuit.

Each of the pair of fusible elements A and B comprises axially outer planar sections A′ and B′ which are substantially parallel to each other and form a gap therebetween. Said pair of fusible elements A,B further comprise axially inner, converging, substantially planar sections A″ and B″. The axially inner sections A″ and B″ converge in opposite directions from the axially inner ends a,a, b,b of the axially outer sections A′, B′ and intersect at substantially straight lines designated by the letters X and Y. Each of the axially outer sections A′,B′ and each of the axially inner sections A″,B″ have points of reduced cross-sectional area r arranged at points remote from the intersections of the planes defined by axially outer sections A′,B′ and the planes defined by axially inner section A″,B″. Hence the points where maximum stresses occur during cycling operations, i.e. points X,Y and a,b are separated from points r where the fusible elements A,B are weakest.

The structure which has been described heretofore is the same as that described in the above referred-to patent to P. C. Jacobs, Jr. U.S. Pat. No. 3,493,333, and the novel features added to that prior art structure will now be described below.

The improvement according to the present invention comprises a sheet of electric insulating material 6 evolving gas under the action of electric arcs, or more succinctly gas-evolving material. Sheet 6 is inserted into the gap formed between the axially outer sections A′,B′ and the axially inner sections A″,B″ of fusible elements A,B. The sheet of electric insulating material 6 has a length L but slightly shorter than the spacing between the axially inner end surfaces 3*a* of terminal elements 3. Hence plate 6 is substantially prevented from moving relative to the pair of fusible elements A,B in the direction longitudinally of casing 1. No fastener means are required to achieve this end. Plate 6 may either abut against terminal plugs 3, or stopped from moving by a small layer of granular arc-quenching filler 2 between terminal plugs 3 and two of the parallel sides or edges 6*a* of plate 6. The width L′ of gas-evolving plate 6 is slightly less than the inner diameter of casing 1. This prevents the edges 6*b* of plate 6 from substantially moving relative to the pair of fusible elements A and B in a direction transverse to casing 1. In other words, the axially inner end surfaces 3*a* of terminal elements 3 and the inner surface of casing 1 form virtual abutments for plate 6.

Plate 6 is preferably rectangular in shape, having two parallel sides thereof juxtaposed to terminal elements or terminal plugs 3, and two parallel sides thereof juxtaposed to casing 1.

The gas-evolving ingredients of plate 6 include preferably melamine resin and aluminum trihydrate.

On occurrence of major fault currents arcs will form at the points of reduced cross-section r, result in the evolution of gas from plate 6, and the increase in gas pressure will significantly help arc extinction.

It will further be evident from the geometry of fusible elements A and B that the points of reduced cross-section r of the axially outer fusible element sections A',B' will be closer to plate 6 than the points of reduced cross-section r of the axially inner fusible element sections A",B". Fusion of all points r occurs almost simultaneously, since they have the same cross-section and are of the same metal. The pressure wave resulting from the arcs of points r on fusible element sections A',B' will reach plate 6 at an earlier time than the pressure wave resulting from the arcs r on fusible element sections A",B". As a result, the build-up of pressure in casing 1 is gradual rather than sudden and does not require an increase of the dynamic strength of casing 1.

I claim as my invention:

1. An electric fuse comprising a tubular casing of electric insulating material; a pulverulent arc-quenching filler inside said casing; a pair of terminal elements having axially inner end surfaces closing said casing; a pair of fusible elements conductively interconnecting said pair of terminal elements; said pair of fusible elements comprising axially outer, parallel, substantially planar sections; and said pair of fusible elements further comprising axially inner substantially planar converging sections, said axially inner sections converging in opposite directions from the axially inner ends of said axially outer sections and intersect at substantially straight lines, each of said axially outer sections and each of said axially inner sections having points of reduced cross-sectional area arranged at points thereof remote from the intersections of the planes defined by said axially outer sections and the planes defined by said axially inner sections; wherein the improvement comprises a sheet of electric insulating material evolving gas under the action of an electric arc inserted into the gap formed between said pair of fusible elements, said sheet of electric insulating material having a length but slightly shorter than the spacing between said axially inner end surfaces of said pair of terminal elements so as to be substantially prevented from moving relative to said pair of fusible elements in a direction longitudinally of said casing, and said sheet of electric insulating material having a width but slightly less than the inner diameter of said casing so as to be substantially prevented from moving relative to said pair of fusible elements in a direction transversely of said casing.

2. An electric fuse as specified in claim 1 wherein said sheet is rectangular, two parallel sides thereof being juxtaposed to said pair of terminal elements and two parallel sides thereof being juxtaposed to said casing.

3. An electric fuse as specified in claim 1 wherein said plate comprises melamine resin and aluminum trihydrate.

* * * * *